US008212691B2

(12) United States Patent
Pudar

(10) Patent No.: US 8,212,691 B2
(45) Date of Patent: Jul. 3, 2012

(54) CONTROLLING LOCATION-BASED SERVICES USING A PORTABLE PRIVACY KEY

(75) Inventor: Nikola J. Pudar, Farmington Hills, MI (US)

(73) Assignee: General Motors LLC, Detroit, MI (US)

( * ) Notice: Subject to any disclaimer, the term of this patent is extended or adjusted under 35 U.S.C. 154(b) by 486 days.

(21) Appl. No.: 12/496,015

(22) Filed: Jul. 1, 2009

(65) Prior Publication Data

US 2011/0001638 A1 Jan. 6, 2011

(51) Int. Cl.
*G08B 21/00* (2006.01)

(52) U.S. Cl. ..... 340/988; 340/905; 701/300

(58) Field of Classification Search ..... 340/905, 340/988, 991, 992, 993; 701/1, 36, 200, 701/207, 300

See application file for complete search history.

(56) References Cited

U.S. PATENT DOCUMENTS

2009/0322560 A1* 12/2009 Tengler et al. ..... 340/905

* cited by examiner

*Primary Examiner* — Jeffery Hofsass

(74) *Attorney, Agent, or Firm* — Anthony L. Simon; Reising Ethington P.C.

(57) ABSTRACT

A method for controlling location-based services for a vehicle that includes establishing a user-selected location-based service preference for a vehicle, linking a portable privacy key to the vehicle, communicating the presence of the portable privacy key from the vehicle to a call center, sending the user-selected location-based service preference from the call center to the vehicle, and activating at least one location-based service in response to linking of the portable privacy key to the vehicle.

20 Claims, 3 Drawing Sheets

CONTROLLING LOCATION-BASED SERVICES USING A PORTABLE PRIVACY KEY

TECHNICAL FIELD

The present invention generally relates to providing location-based services and, more specifically, to the use of a privacy key in conjunction with location-based services.

BACKGROUND

Vehicle manufacturers install an ever-increasing number of communication and location technologies on vehicles. These technologies enable a vehicle to transmit a wide variety of data to a central facility and/or third parties. In one example, a vehicle telematics device can send voice and data communications and global positioning system (GPS) coordinates through a wireless network to a central facility, such as a call center. The data or GPS coordinates can be used to provide useful location-based services. Examples of location-based services include using the GPS coordinates to locate the vehicle on a map, determine if the vehicle has left an area, or identifying the route of the vehicle as it moves.

However, some location-based services, such as accessing the exact position of a vehicle or the vehicle's real-time route, can cause privacy concerns. For instance, in some situations the user of the vehicle is unaware that a subscriber to the location-based services or other person can determine the vehicle's location. Suppliers of location-based services may wish to balance the interests of the location-based service subscriber and those of the user of the vehicle. Or in other words, it can be helpful to give the location-based subscriber access to detailed vehicle location information while simultaneously alerting a vehicle occupant that location-based services or vehicle location information are available to a vehicle owner or third party.

SUMMARY OF THE INVENTION

According to one embodiment, a method for controlling location-based services for a vehicle is provided. The method includes the steps of: establishing a user-selected location-based service preference for a vehicle, linking a portable privacy key to the vehicle, communicating the presence of the portable privacy key from the vehicle to a call center, sending the user-selected location-based service preference from the call center to the vehicle, and activating at least one location-based service in response to linking of the portable privacy key to the vehicle.

According to another embodiment, a method for controlling location-based services for a vehicle is provided. The method includes the steps of: linking a portable privacy key to a vehicle, activating at least one location-based service, signaling to a vehicle occupant that the portable privacy key has enabled a location-based service, monitoring vehicle latitude and longitude, vehicle speed, or time of day during which the vehicle is operating for a value exceeding a predetermined threshold, sending a message from a telematics device to a subscriber of the location-based service if the portable privacy key is unlinked from the vehicle, and sending a message from the telematics device to the subscriber if the value exceeds the preset threshold.

According to yet another embodiment, a method for controlling location-based services for a vehicle is provided. The method includes the steps of: establishing a subscriber account that a contains a unique code, a location-based service, and a threshold not to be exceeded, encoding a portable privacy key with the unique code, placing the portable privacy key in communication with a vehicle telematics unit, extracting the unique code from the portable privacy key using the vehicle telematics unit, transmitting the unique code from the vehicle telematics unit to a call center, receiving the unique code at the call center, determining if the unique code of the portable privacy key is associated with an active subscriber account; if the unique code is associated with an active subscriber account, transmitting a confirmation signal that indicates the location-based service and the threshold contained in the vehicle owner account from the call center to the vehicle, activating the location-based service, monitoring the location-based service for values that exceed the threshold, and if the threshold is exceeded, notifying the subscriber.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

The method described below in conjunction with FIGS. 1-3 can be carried out as part of the vehicle communications system shown in FIG. 1. One particular use of the method is to allow a location-based service subscriber access to detailed vehicle location data while also providing control to the vehicle occupant over the subscriber's access to that data. For instance, the vehicle occupant can link a portable privacy key with the vehicle and the key can permit the location-based service subscriber to access at least one location-based service provided by the vehicle and/or call center. However, the vehicle occupant can unlink the portable privacy key from the vehicle and prevent the subscriber from accessing vehicle location data or location-based services. But when the portable privacy key is linked or unlinked, the vehicle can alert the subscriber of this action. In other words, the subscriber may access the vehicle location data or location-based services, but the vehicle occupant explicitly consents to this access by voluntarily linking the portable privacy key that enables the location-based services or acquiesces by operating the vehicle while knowing that the location-based services is active. And access can end when the vehicle occupant unlinks the portably privacy key. Examples of location-based services include providing the precise location of the vehicle, identifying the route the vehicle has driven, establishing geofencing boundaries beyond which the vehicle should not travel, or monitoring times during which the vehicle should not operate. Location-based services can be used to help monitor the safely of a child or loved one.

Figure 1:
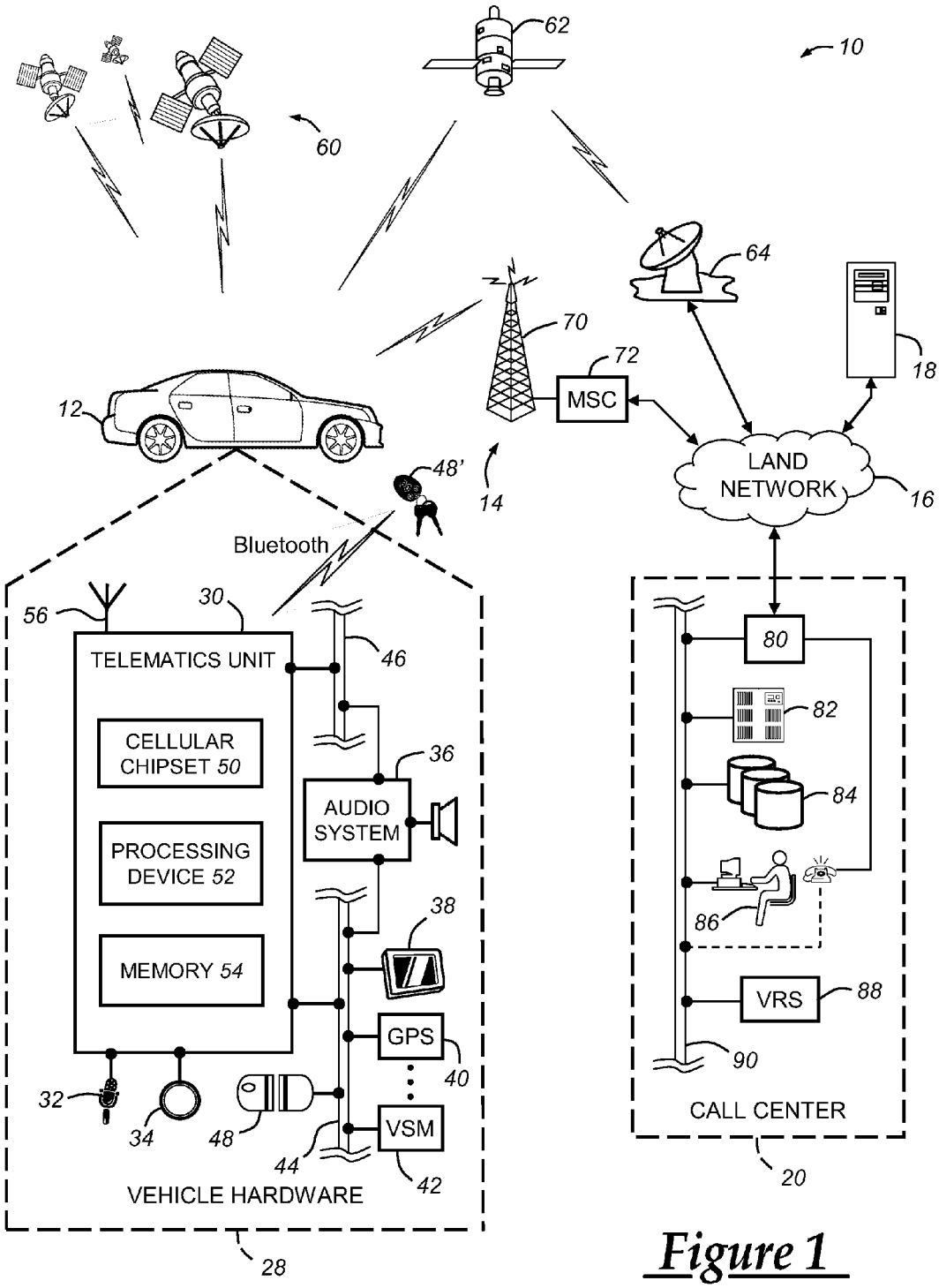
FIG. 1 is a block diagram depicting an exemplary embodiment of a communications system that is capable of utilizing the method disclosed herein.

With reference to FIG. 1, there is shown an exemplary operating environment that comprises a mobile vehicle communications system 10 and that can be used to implement the method disclosed herein. Communications system 10 generally includes a vehicle 12, one or more wireless carrier systems 14, a land communications network 16, a computer 18, and a call center 20. It should be understood that the disclosed method can be used with any number of different systems and is not specifically limited to the operating environment shown here. Also, the architecture, construction, setup, and operation of the system 10 and its individual components are generally known in the art. Thus, the following paragraphs simply provide a brief overview of one such exemplary system 10; however, other systems not shown here could employ the disclosed method as well.

Vehicle 12 is depicted in the illustrated embodiment as a passenger car, but it should be appreciated that any other vehicle including motorcycles, trucks, sports utility vehicles (SUVs), recreational vehicles (RVs), marine vessels, etc., can also be used. Some of the vehicle electronics 28 is shown generally in FIG. 1 and includes a telematics unit 30, a microphone 32, one or more pushbuttons or other control inputs 34, an audio system 36, a visual display 38, a portable privacy key (PPK) 48, and a GPS module 40 as well as a number of vehicle system modules (VSMs) 42. Some of these devices can be connected directly to the telematics unit 30 such as, for example, the microphone 32 and pushbutton(s) 34, whereas others are indirectly connected using one or more network connections, such as a communications bus 44 or an entertainment bus 46. Examples of suitable network connections include a controller area network (CAN), a media oriented system transfer (MOST), a local interconnection network (LIN), a local area network (LAN), and other appropriate connections such as Ethernet or others that conform with known ISO, SAE and IEEE standards and specifications, to name but a few.

Telematics unit 30 is an OEM-installed device that enables wireless voice and/or data communication over wireless carrier system 14 and via wireless networking so that the vehicle can communicate with call center 20, other telematics-enabled vehicles, or some other entity or device. The telematics unit preferably uses radio transmissions to establish a communications channel (a voice channel and/or a data channel) with wireless carrier system 14 so that voice and/or data transmissions can be sent and received over the channel. By providing both voice and data communication, telematics unit 30 enables the vehicle to offer a number of different services including those related to navigation, telephony, emergency assistance, diagnostics, infotainment, etc. Data can be sent either via a data connection, such as via packet data transmission over a data channel, or via a voice channel using techniques known in the art. For combined services that involve both voice communication (e.g., with a live advisor or voice response unit at the call center 20) and data communication (e.g., to provide GPS location data or vehicle diagnostic data to the call center 20), the system can utilize a single call over a voice channel and switch as needed between voice and data transmission over the voice channel, and this can be done using techniques known to those skilled in the art.

According to one embodiment, telematics unit 30 utilizes cellular communication according to either GSM or CDMA standards and thus includes a standard cellular chipset 50 for voice communications like hands-free calling, a wireless modem for data transmission, an electronic processing device 52, one or more digital memory devices 54, and a dual antenna 56. It should be appreciated that the modem can either be implemented through software that is stored in the telematics unit and is executed by processor 52, or it can be a separate hardware component located internal or external to telematics unit 30. The modem can operate using any number of different standards or protocols such as EVDO, CDMA, GPRS, and EDGE. Wireless networking between the vehicle and other networked devices can also be carried out using telematics unit 30. For this purpose, telematics unit 30 can be configured to communicate wirelessly according to one or more wireless protocols, such as any of the IEEE 802.11 protocols, WiMAX, or Bluetooth. When used for packet-switched data communication such as TCP/IP, the telematics unit can be configured with a static IP address or can set up to automatically receive an assigned IP address from another device on the network such as a router or from a network address server.

Processor 52 can be any type of device capable of processing electronic instructions including microprocessors, microcontrollers, host processors, controllers, vehicle communication processors, and application specific integrated circuits (ASICs). It can be a dedicated processor used only for telematics unit 30 or can be shared with other vehicle systems. Processor 52 executes various types of digitally-stored instructions, such as software or firmware programs stored in memory 54, which enable the telematics unit to provide a wide variety of services. For instance, processor 52 can execute programs or process data to carry out at least a part of the method discussed herein.

Telematics unit 30 can be used to provide a diverse range of vehicle services that involve wireless communication to and/or from the vehicle. Such services include: turn-by-turn directions and other navigation-related services that are provided in conjunction with the GPS-based vehicle navigation module 40; airbag deployment notification and other emergency or roadside assistance-related services that are provided in connection with one or more collision sensor interface modules such as a body control module (not shown); diagnostic reporting using one or more diagnostic modules; and infotainment-related services where music, webpages, movies, television programs, videogames and/or other information is downloaded by an infotainment module (not shown) and is stored for current or later playback. The above-listed services are by no means an exhaustive list of all of the capabilities of telematics unit 30, but are simply an enumeration of some of the services that the telematics unit is capable of offering. Furthermore, it should be understood that at least some of the aforementioned modules could be implemented in the form of software instructions saved internal or external to telematics unit 30, they could be hardware components located internal or external to telematics unit 30, or they could be integrated and/or shared with each other or with other systems located throughout the vehicle, to cite but a few possibilities. In the event that the modules are implemented as VSMs 42 located external to telematics unit 30, they could utilize vehicle bus 44 to exchange data and commands with the telematics unit.

The telematics unit 30 also communicates with the portable privacy key (PPK) 48 to provide a variety of services. The PPK 48 is a hardware device that enables location-based services in a vehicle 12. The PPK 48 includes a unique code that can be associated with the vehicle and a subscriber account for enabling location-based services, and can itself include hardware such as processing capabilities, memory for storing data, a radio-frequency identification (RFID) chip, or a transceiver for communicating with a vehicle 12. The telematics unit 30 can communicate with the PPK 48 via the communications bus 44 over a fixed connection that can involve physically coupling the PPK 48 with the vehicle 12. In that sense, the PPK 48 can take the form of a male or female plug that fits into/around a receiving portion permanently affixed to the vehicle 12. In another example, the fixed connection between the PPK 48/vehicle 12/telematics unit 30/communications bus 44 can include a detachable wire. In another example, the telematics unit 30 can communicate wirelessly with a PPK 48' using a short-range wireless protocol, such as Bluetooth. In any case, whether physically coupled to the vehicle 12 or wirelessly communicating with the telematics unit 30, the PPK 48' can be incorporated into a vehicle key used for operating the vehicle 12 or into a key fob or token carried by a user.

GPS module 40 receives radio signals from a constellation 60 of GPS satellites. From these signals, the module 40 can determine vehicle position that is used for providing navigation and other position-related services to the vehicle driver. Navigation information can be presented on the display 38 (or other display within the vehicle) or can be presented verbally such as is done when supplying turn-by-turn navigation. The navigation services can be provided using a dedicated in-vehicle navigation module (which can be part of GPS module 40), or some or all navigation services can be done via telematics unit 30, wherein the position information is sent to a remote location for purposes of providing the vehicle with navigation maps, map annotations (points of interest, restaurants, etc.), route calculations, and the like. The position information can be supplied to call center 20 or other remote computer system, such as computer 18, for other purposes, such as fleet management. Also, new or updated map data can be downloaded to the GPS module 40 from the call center 20 via the telematics unit 30.

Apart from the audio system 36 and GPS module 40, the vehicle 12 can include other vehicle system modules (VSMs) 42 in the form of electronic hardware components that are located throughout the vehicle and typically receive input from one or more sensors and use the sensed input to perform diagnostic, monitoring, control, reporting and/or other functions. Each of the VSMs 42 is preferably connected by communications bus 44 to the other VSMs, as well as to the telematics unit 30, and can be programmed to run vehicle system and subsystem diagnostic tests. As examples, one VSM 42 can be an engine control module (ECM) that controls various aspects of engine operation such as fuel ignition and ignition timing, another VSM 42 can be a powertrain control module that regulates operation of one or more components of the vehicle powertrain, and another VSM 42 can be a body control module that governs various electrical components located throughout the vehicle, like the vehicle's power door locks and headlights. According to one embodiment, the engine control module is equipped with on-board diagnostic (OBD) features that provide myriad real-time data, such as that received from various sensors including vehicle emissions sensors, and provide a standardized series of diagnostic trouble codes (DTCs) that allow a technician to rapidly identify and remedy malfunctions within the vehicle. As is appreciated by those skilled in the art, the above-mentioned VSMs are only examples of some of the modules that may be used in vehicle 12, as numerous others are also possible.

Vehicle electronics 28 also includes a number of vehicle user interfaces that provide vehicle occupants with a means of providing and/or receiving information, including microphone 32, pushbuttons(s) 34, audio system 36, and visual display 38. As used herein, the term 'vehicle user interface' broadly includes any suitable form of electronic device, including both hardware and software components, which is located on the vehicle and enables a vehicle user to communicate with or through a component of the vehicle. Microphone 32 provides audio input to the telematics unit to enable the driver or other occupant to provide voice commands and carry out hands-free calling via the wireless carrier system 14. For this purpose, it can be connected to an on-board automated voice processing unit utilizing human-machine interface (HMI) technology known in the art. The pushbutton(s) 34 allow manual user input into the telematics unit 30 to initiate wireless telephone calls and provide other data, response, or control input. Separate pushbuttons can be used for initiating emergency calls versus regular service assistance calls to the call center 20. Audio system 36 provides audio output to a vehicle occupant and can be a dedicated, stand-alone system or part of the primary vehicle audio system. According to the particular embodiment shown here, audio system 36 is operatively coupled to both vehicle bus 44 and entertainment bus 46 and can provide AM, FM and satellite radio, CD, DVD and other multimedia functionality. This functionality can be provided in conjunction with or independent of the infotainment module described above. Visual display 38 is preferably a graphics display, such as a touch screen on the instrument panel or a heads-up display reflected off of the windshield, and can be used to provide a multitude of input and output functions. Various other vehicle user interfaces can also be utilized, as the interfaces of FIG. 1 are only an example of one particular implementation.

Wireless carrier system 14 is preferably a cellular telephone system that includes a plurality of cell towers 70 (only one shown), one or more mobile switching centers (MSCs) 72, as well as any other networking components required to connect wireless carrier system 14 with land network 16. Each cell tower 70 includes sending and receiving antennas and a base station, with the base stations from different cell towers being connected to the MSC 72 either directly or via intermediary equipment such as a base station controller. Cellular system 14 can implement any suitable communications technology, including for example, analog technologies such as AMPS, or the newer digital technologies such as CDMA (e.g., CDMA2000) or GSM/GPRS. As will be appreciated by those skilled in the art, various cell tower/base station/MSC arrangements are possible and could be used with wireless system 14. For instance, the base station and cell tower could be co-located at the same site or they could be remotely located from one another, each base station could be responsible for a single cell tower or a single base station could service various cell towers, and various base stations could be coupled to a single MSC, to name but a few of the possible arrangements.

Apart from using wireless carrier system 14, a different wireless carrier system in the form of satellite communication can be used to provide uni-directional or bi-directional communication with the vehicle. This can be done using one or more communication satellites 62 and an uplink transmitting station 64. Uni-directional communication can be, for example, satellite radio services, wherein programming content (news, music, etc.) is received by transmitting station 64, packaged for upload, and then sent to the satellite 62, which broadcasts the programming to subscribers. Bi-directional communication can be, for example, satellite telephony services using satellite 62 to relay telephone communications between the vehicle 12 and station 64. If used, this satellite telephony can be utilized either in addition to or in lieu of wireless carrier system 14.

Land network 16 may be a conventional land-based telecommunications network that is connected to one or more landline telephones and connects wireless carrier system 14 to call center 20. For example, land network 16 may include a public switched telephone network (PSTN) such as that used to provide hardwired telephony, packet-switched data communications, and the Internet infrastructure. One or more segments of land network 16 could be implemented through the use of a standard wired network, a fiber or other optical network, a cable network, power lines, other wireless networks such as wireless local area networks (WLANs), or networks providing broadband wireless access (BWA), or any combination thereof. Furthermore, call center 20 need not be connected via land network 16, but could include wireless telephony equipment so that it can communicate directly with a wireless network, such as wireless carrier system 14.

Computer 18 can be one of a number of computers accessible via a private or public network such as the Internet. Each such computer 18 can be used for one or more purposes, such as a web server accessible by the vehicle via telematics unit 30 and wireless carrier 14. Other such accessible computers 18 can be, for example: a service center computer where diagnostic information and other vehicle data can be uploaded from the vehicle via the telematics unit 30; a client computer used by the vehicle owner or other subscriber for such purposes as accessing or receiving vehicle data or to setting up or configuring subscriber preferences or controlling vehicle functions; or a third party repository to or from which vehicle data or other information is provided, whether by communicating with the vehicle 12 or call center 20, or both. A computer 18 can also be used for providing Internet connectivity such as DNS services or as a network address server that uses DHCP or other suitable protocol to assign an IP address to the vehicle 12.

Call center 20 is designed to provide the vehicle electronics 28 with a number of different system back-end functions and, according to the exemplary embodiment shown here, generally includes one or more switches 80, servers 82, databases 84, live advisors 86, as well as an automated voice response system (VRS) 88, all of which are known in the art. These various call center components are preferably coupled to one another via a wired or wireless local area network 90. Switch 80, which can be a private branch exchange (PBX) switch, routes incoming signals so that voice transmissions are usually sent to either the live adviser 86 by regular phone or to the automated voice response system 88 using VoIP. The live advisor phone can also use VoIP as indicated by the broken line in FIG. 1. VoIP and other data communication through the switch 80 is implemented via a modem (not shown) connected between the switch 80 and network 90. Data transmissions are passed via the modem to server 82 and/or database 84. Database 84 can store account information such as subscriber authentication information, vehicle identifiers, profile records, behavioral patterns, and other pertinent subscriber information. Data transmissions may also be conducted by wireless systems, such as 802.11x, GPRS, and the like. Although the illustrated embodiment has been described as it would be used in conjunction with a manned call center 20 using live advisor 86, it will be appreciated that the call center can instead utilize VRS 88 as an automated advisor or, a combination of VRS 88 and the live advisor 86 can be used.

Services offered by a call center or service provider generally involve location-based services. Examples of location-based services GPS services and speed limit alerts. GPS services include breadcrumbing, geofencing, and curfew alerts. Breadcrumbing involves establishing the position of a route the vehicle has taken at predefined time intervals and from these positions determining a vehicle route. Geofencing can include identifying virtual geographical boundaries using a plurality of GPS coordinates and detecting if a vehicle moves beyond the virtual geographical boundaries. Curfew alerts can include geofencing and adding a time interval during which a vehicle should be within or outside of a geofenced area. For example, a curfew alert can be set that defines the property boundary of a residence as a geofenced boundary. In addition, the curfew alert can include a time interval between 11 PM and 6 AM during any particular day, a recurring day (e.g. every Friday), or all days. If the vehicle is outside of the boundary of a residence during the time from 11 PM to 6 AM, the vehicle 12 can signal this status to a call center and/or directly to a subscriber.

Additionally, speed limit alerts can also be set that alert the subscriber if a vehicle exceeds a subscriber-defined speed threshold. For instance, this service can use a plurality of GPS coordinates and measure the elapsed time between two or more points to calculate the speed of the vehicle between those two points. If the calculated speed between the two points exceeds the speed threshold, the subscriber is notified. In another example, a sensor coupled to at least one wheel can detect the speed of that wheel and relay the wheel speed to the telematics unit. If the sensor detects a speed that exceeds the speed threshold, the subscriber is notified. While the concepts of location-based services are described above, a variety of implementations and configurations are known to those skilled in the art.

Figure 2:
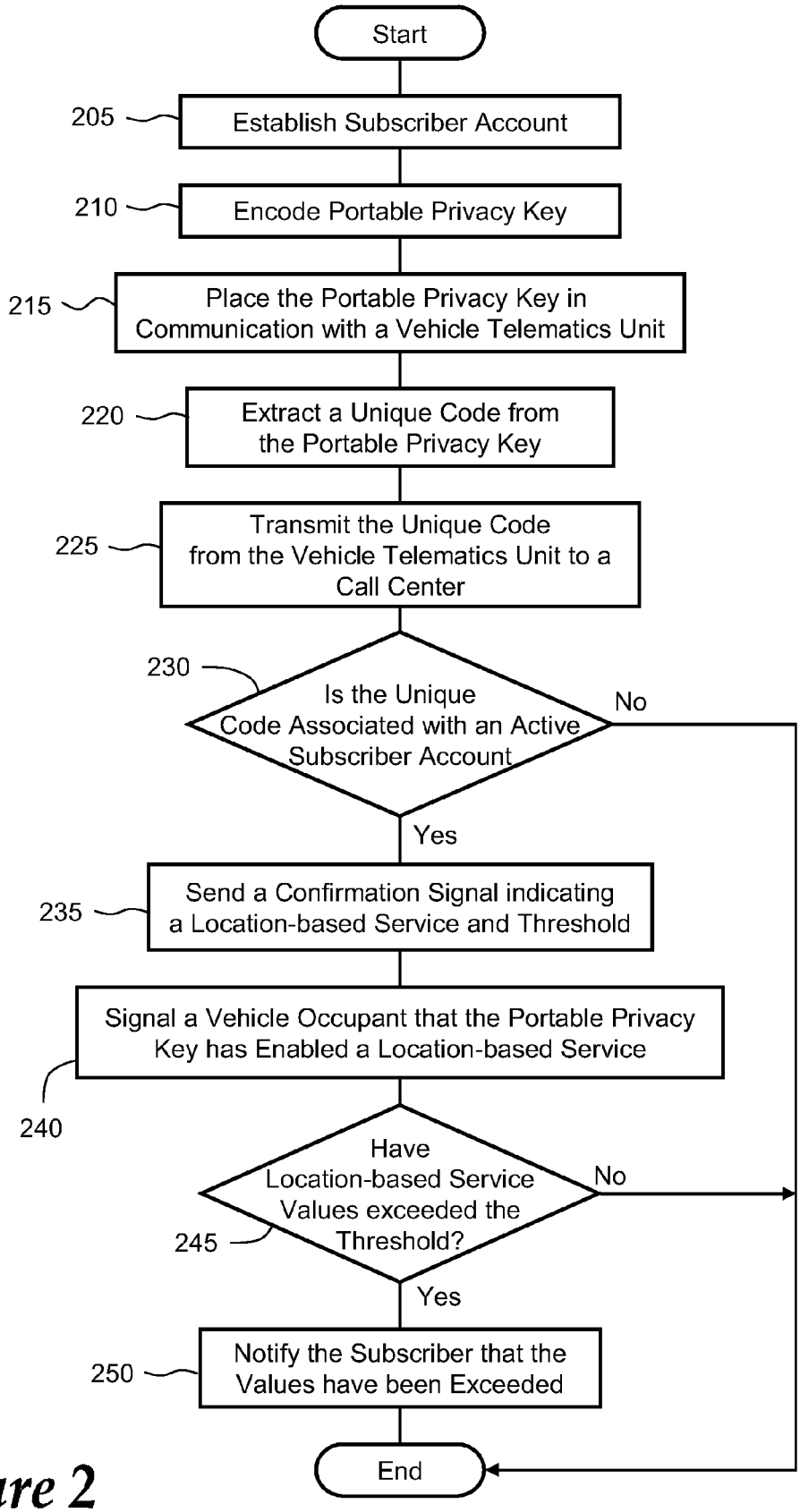
FIG. 2 is a flow chart depicting an exemplary embodiment of a method for using a location-based services privacy key.
Figure 3:
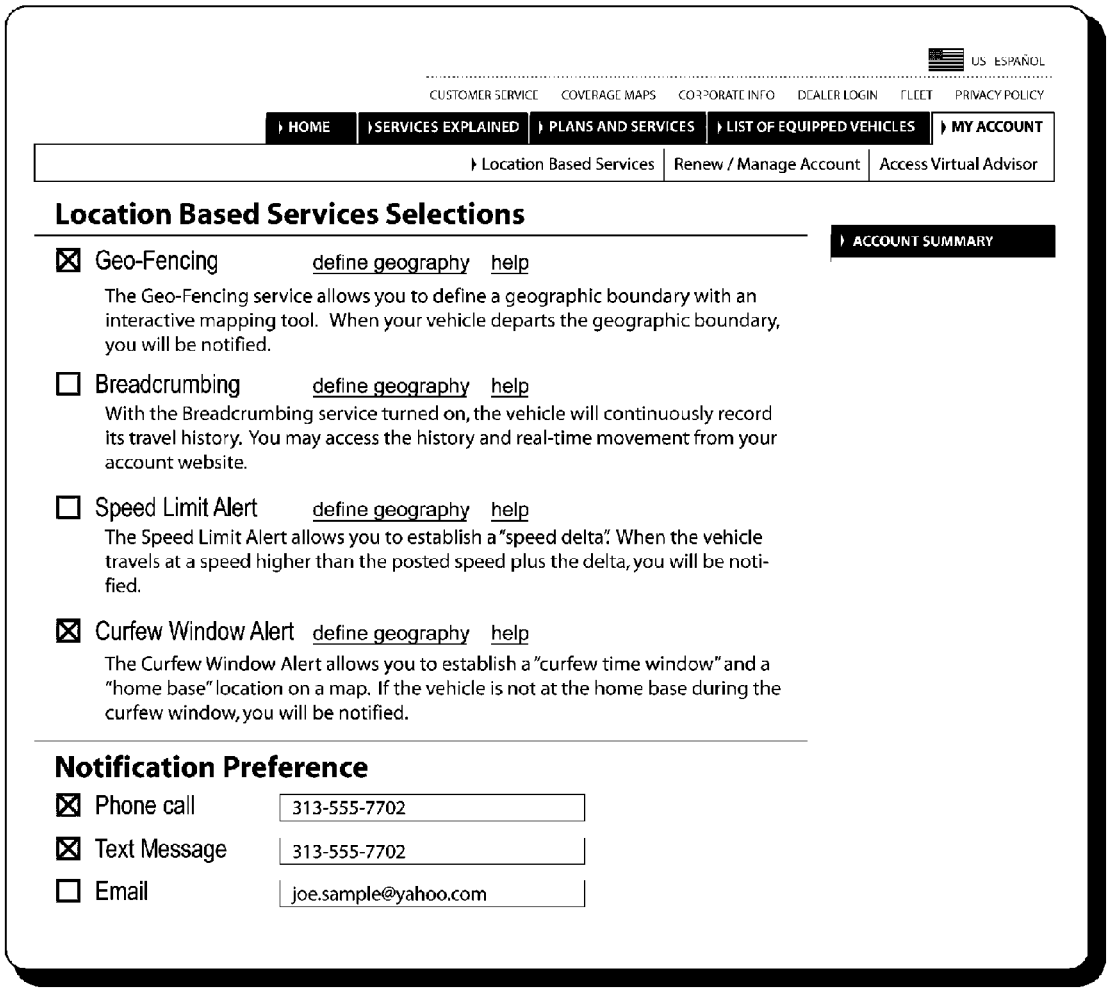
FIG. 3 is a screen shot of an exemplary graphical-user interface.

Turning now to FIG. 2, there is shown a block diagram of a method for using a location-based services privacy key. The method 200 begins at step 205 with establishing a subscriber account that contains a unique code, a location-based service, and a threshold not to be exceeded. Establishing a subscriber account involves contacting a service provider and subscribing to the provider's offered services. A subscriber or potential subscriber can contact the service provider, such as a call center, and activate an account with the provider, thus, establishing a subscriber account. A subscriber can establish an account by contacting the service provider via a telephone call to a call center, interacting with the service provider using a web portal and a personal computer (PC), or providing personal and vehicle information on a paper application and mailing it to the service provider. When the account is established, a unique code can be associated with the account that uniquely identifies each account. The unique code can comprise a string of alpha numeric characters of various lengths. Additionally, the unique code for each account can be stored in a database at a call center.

Once a subscriber account and its unique code is established, the number of location-based services and various thresholds can be specified by the subscriber to help define the extent to which location-based services are provided to the subscriber. The subscriber can communicate with the service provider using one of the contact methods available to establish the subscriber account. For example, the subscriber can use a web portal to communicate with the service provider and establish which location-based services will be enabled and the thresholds associated with each location-based service. If the subscriber desired to activate the breadcrumbing, geofencing, curfew alerts, and speed alerts, the subscriber could do so by selecting the services using the web portal. The subscriber can then be prompted, through the portal, to enter thresholds for each selected service. FIG. 3 provides an exemplary graphical user interface that can be made accessible to the subscriber via an internet connection. This user interface is supported by the web portal provided by the call center 20 and allows the subscriber to select and configure location-based services.

Using the present example, the user may first be prompted to establish thresholds for breadcrumbing. Thresholds for breadcrumbing can include the time interval at which GPS coordinates are recorded for determining the route of the vehicle. Subscribers can similarly set thresholds for geofencing. For geofencing, the service provider can prompt the subscriber to enter a plurality of latitude and longitude coordinates. Or the subscriber can be prompted to select an plurality of pre-entered latitude and longitude coordinates or to enter the name of established geographical areas, such as a city, township or state. Curfew alerts can involve prompting the subscriber to specify a geofenced area as described above and to associate with that area a time range and/or day of the week. Establishing speed alerts can involve specifying a speed value. The speed alert can be a specified speed value (e.g. a fixed threshold) and/or can involve the detection of a speed change relative to the specified speed value. For instance, the subscriber can set a speed value and the vehicle 12 can detect when the value has been exceeded by a certain amount or percentage, such as 10%. Or in another example, different speed alerts may be linked to each type of road. For instance, traveling 70 miles per hour (MPH) may be allowable on highways and interstates, but on other roads this speed may be excessive. Thus, the subscriber can set the threshold at 70 MPH for highways and interstates while setting another threshold, such as 50 MPH, for all other roads. The method 200 proceeds to step 210.

At step 210, the portable privacy key 48 is encoded with the unique code. For instance, a PPK 48 can be encoded with the unique code during its manufacture. In this sense, the unique code is similar to an electronic serial number (ESN), and when a subscriber activates an account with a service provider, the account can be identified by the unique code of the PPK 48. In another example, the subscriber can receive the unique code from the service provider when activating an account; the code associated with the account can then be programmed into the PPK 48. It is envisioned that in some embodiments, the PPK 48 can store the subscriber's location-based service preferences and/or thresholds in addition to the unique code. The method 200 proceeds to step 215.

At step 215, the portable privacy key 48 is placed in communications with a vehicle telematics unit. The PPK 48 can communicate information for enabling location-based services to the vehicle 12. Communication can take many forms. In one example, the PPK 48 can include an RFID chip that communicates the presence of the PPK 48 to the vehicle or telematics unit. In yet another example, the PPK 48 can be physically connected to the vehicle and the information contained on the PPK 48 can be communicated via wired bus to a vehicle telematics unit. Alternatively, the PPK 48' can use a transceiver to wirelessly communicate with the telematics unit 30. Essentially, by placing the PPK 48 in communication with the vehicle, it tells the vehicle to activate the location-based services. This activation can be passive, such as simply by virtue of the privacy key being physically or wirelessly connected to the vehicle, or can be active, requiring the vehicle user to press a button or otherwise activate the location-based services using the PPK 48. In some embodiments, the subscriber can be alerted when activation occurs or when the PPK is either deactivated or the vehicle operated without the PPK being used. The subscriber can be alerted in a variety of ways, such as short message service (SMS) or email. Similarly, the subscriber can also be alerted when the communications between the PPK 48 and the vehicle 12 end. After receiving notification that location-based services have been activated or deactivated, the subscriber can be aware of the status for location-based services on a particular vehicle. The method 200 proceeds to step 220.

At step 220, the unique code is extracted from the portable privacy key using the vehicle telematics unit. After communication between the PPK 48 and the vehicle 12 has been established, the unique code can be obtained from the PPK 48 and transmitted to the telematics unit 30. The RFID chip can wirelessly communicate the unique code to the vehicle 12, which indicates the subscriber account and/or preferences associated with that account. In another example, the PPK 48 can include a transceiver that can obtain the unique code, subscriber account information, and/or thresholds and communicate any one or more of them to the vehicle 12 or telematics unit 30. Subscriber account information can include which location-based service the subscriber has activated. If the PPK 48 is physically connected to the vehicle 12, the unique code, subscriber account information, or thresholds can be sent to the telematics unit 30 through the communications bus 44. The method 200 proceeds to step 225.

At step 225, the unique code is transmitted from the vehicle telematics unit and received at the call center. That is, having obtained the unique code, the telematics unit can send the unique code via the wireless network 14 to a central facility. Alternatively, the vehicle telematics unit 30 can signal the call center 20 that the PPK 48 is linked or communicating with the vehicle 12. The central facility can be a call center 20 or any other land-based facility capable of receiving transmissions from the vehicle 12. The method 200 proceeds to step 230.

At step 230, it is determined if the unique code of the portable privacy key is associated with an active subscriber account. At the central facility or call center 20, the unique code can be compared to a database of subscriber accounts maintained there. The database of subscriber accounts can include the unique code associated with each subscriber account. If the unique code associated with a PPK 48 does not match a subscriber account, the method 200 ends. If the unique code does match a subscriber account, the method 200 proceeds to step 235.

At step 235, a confirmation signal is transmitted from the call center to the vehicle indicating a location-based service and the threshold contained in the subscriber account if the unique code is associated with a subscriber account. This confirmation signal can be received by the vehicle telematics unit 30 and acknowledge the existence of an active or valid subscriber account. In one example, the confirmation signal can include only the unique code. When the confirmation signal includes only the unique code, it is possible for a subscriber to enter and store subscriber preferences at the vehicle 12. In that example, the unique code acts to enable identified location-based services and preferences that are presently or were previously inputted by the subscriber at the vehicle 12. In another example, the confirmation signal can include those subscriber preferences. For instance, the subscriber preferences can include the particular location-based services that are activated, the thresholds chosen by the subscriber, or the unique code. The method 200 proceeds to step 240.

At step 240, a vehicle occupant is signaled that the portable privacy key has enabled a location-based service. Once at least one location-based service has been enabled, an audio and/or visual signal attempts to alert the driver or passenger that operation of the vehicle 12 (e.g. position and/or speed) is being monitored. Signals that alert the vehicle occupant include a light-emitting diode (LED) located on the PPK 48 that emits light when location-based services are enabled or the PPK 48 is communicating with the vehicle. In another example, a light positioned on the instrument panel of the vehicle can be illuminated when location-based services are enabled or when the PPK 48 is communicating with the vehicle. Also, enabling location-based service can be followed by an audible sound or statement indicating to the driver or passenger that the position and/or speed of the vehicle are/is being monitored. This audible message can be presented, for example, via the audio system 36. Similarly, the audio or visual signals described above can be used to alert the driver or passenger that location-based services have been deactivated as well. When deactivating location-based services, the LED will stop illuminating and/or and audible sound or statement will indicate that the services have been deactivated. The method 200 proceeds to step 245.

At step 245, the location-based service is monitored for values that exceed the threshold. These values can include latitude and longitude (e.g. GPS coordinates), vehicle speed, time of day during which the vehicle 12 is operating, etc. For instance, the GPS coordinates representing the present location of the vehicle 12 can be periodically compared to established geofence boundaries/thresholds and if the vehicle 12 moves into or out of a geofence boundary, the vehicle 12 can detect this status. In another example, time and date and GPS coordinates can be compared to curfew thresholds. If the vehicle 12 moves into or out of a geofence boundary during a threshold time/day combination, the vehicle can detect this status. Also, the GPS position of the vehicle 12 can be periodically recorded and saved as a log for breadcrumbing purposes. Wheel speed can be monitored using the vehicle sensor and if the speed threshold has been exceeded, the vehicle 12 can detect this, also recording the time and date this occurs. Alternatively, the vehicle 12 can use periodically-recorded vehicle GPS coordinates noting the time at which the coordinates were recorded. Using the GPS coordinates and elapsed time, the average speed of the vehicle can be periodically calculated. The calculated average speed can be compared to the speed threshold and if the threshold is exceeded, the vehicle 12 can detect this status. If no threshold is exceeded, the vehicle 12 can periodically upload the breadcrumbing log to the call center 20 for presentation to the subscriber and the method 200 ends. Otherwise, the method 200 proceeds to step 250.

At step 250, the subscriber is notified if the threshold is exceeded. If any threshold is exceeded, the vehicle 12 can alert the subscriber of this status. For instance, if the vehicle 12 exceeds a threshold, the vehicle 12 can send a signal to the call center 20 that alerts the call center 20 that a threshold has been exceeded. In another implementation, the vehicle 12 can send a signal to the call center 20 informing that a threshold has been exceeded, the time and day it was exceeded, and by what margin the threshold was exceeded. The call center 20 can then contact the subscriber, such as via SMS or email, or provide the information to the subscriber via the web portal. In yet another implementation, the vehicle 12 can send the above mentioned data directly to the subscriber's email address or cell phone via email or SMS. The method 200 then ends.

It is to be understood that the foregoing description is of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A method for controlling location-based services for a vehicle, the steps comprising:

(a) establishing a user-selected location-based service preference for a vehicle;

(b) linking a portable privacy key to the vehicle;

(c) communicating the presence of the portable privacy key from the vehicle to a call center;

(d) sending the user-selected location-based service preference from the call center to the vehicle; and (e) activating at least one location-based service in response to linking of the portable privacy key to the vehicle.

2. The method of claim 1, wherein the location-based service further comprises one or more of: breadcrumbing, geofencing, a curfew alert, or a speed limit alert.

3. The method of claim 1, further comprising establishing at least one threshold for each user-selected location-based service preference.

4. The method of claim 3, wherein thresholds further comprise at least one or more of: a speed value, a plurality of latitude and longitude global positioning system (GPS) coordinates, or a plurality of latitude and longitude GPS coordinates associated with a time interval.

5. The method of claim 3, wherein a subscriber can establish at least one threshold at a call center using a web portal.

6. The method of claim 1, wherein the vehicle alerts a vehicle occupant when the portable privacy key is linked or unlinked to the vehicle.

7. The method of claim 1, wherein the portable privacy key includes a visual signal that indicates that illuminates when location-based services are enabled or stops illuminating when location-based services are disabled.

8. The method of claim 1, wherein the vehicle activates an audible alert when the location-based services have been activated or deactivated.

9. The method of claim 1, wherein location-based services further comprises breadcrumbing by recording a plurality of latitude and longitude GPS coordinates; establishing a log of the past route traveled by the vehicle using the plurality of coordinates; and uploading the log to a call center.

10. The method of claim 1, wherein location-based services further comprises:

establishing a threshold speed value;

recording a plurality of latitude and longitude GPS coordinates and the time the GPS coordinates are recorded;

calculating an average speed based on the plurality of GPS coordinates and the time they are recorded; and determining if the average speed exceeds the threshold speed value.

11. The method of claim 1, further comprising establishing a speed limit threshold and linking the speed limit threshold to a type of road.

12. A method for controlling location-based services for a vehicle, the steps comprising:

(a) linking a portable privacy key to a vehicle;

(b) activating at least one location-based service;

(c) signaling to a vehicle occupant that the portable privacy key has enabled a location-based service;

(d) monitoring vehicle latitude and longitude, vehicle speed, or time of day during which the vehicle is operating for a value exceeding a predetermined threshold;

(f) sending a message from a telematics device to a subscriber of the location-based service if the portable privacy key is unlinked from the vehicle; and (g) sending a message from the telematics device to the subscriber if the value exceeds the preset threshold.

13. The method of claim 12, wherein the location-based service further comprises one or more of: breadcrumbing, geofencing, a curfew alert, or a speed limit alert.

14. The method of claim 12, wherein the predetermined threshold further comprises at least one or more of: a speed value, a plurality of latitude and longitude global positioning system (GPS) coordinates, or a plurality of latitude and longitude GPS coordinates associated with a time interval.

15. The method of claim 12, wherein a subscriber can establish the predetermined threshold at a call center using a web portal.

16. The method of claim 12, wherein the portable privacy key includes a visual signal that illuminates when location-based services are enabled or stops illuminating when location-based services are disabled.

17. The method of claim 12, wherein the vehicle activates an audible alert when the location-based services have been activated or deactivated.

18. A method for controlling location-based services for a vehicle, the steps comprising:

(a) establishing a subscriber account that a contains a unique code, a location-based service, and a threshold not to be exceeded;

(b) encoding a portable privacy key with the unique code;

(c) placing the portable privacy key in communication with a vehicle telematics unit;

(d) extracting the unique code from the portable privacy key using the vehicle telematics unit;

(e) transmitting the unique code from the vehicle telematics unit to a call center;

(f) receiving the unique code at the call center;

(g) determining if the unique code of the portable privacy key is associated with an active subscriber account;

(h) if the unique code is associated with an active subscriber account, transmitting a confirmation signal that indicates the location-based service and the threshold contained in the vehicle owner account from the call center to the vehicle;

(i) activating the location-based service;

(j) monitoring the location-based service for values that exceed the threshold; and (k) if the threshold is exceeded, notifying the subscriber.

19. The method of claim 18, wherein the location-based service further comprises one or more of: breadcrumbing, geofencing, a curfew alert, or a speed limit alert.

20. The method of claim 18, wherein a threshold further comprises at least one or more of: a speed value, a plurality of latitude and longitude global positioning system (GPS) coordinates, or a plurality of latitude and longitude GPS coordinates associated with a time interval.

* * * * *